United States Patent [19]

Schneider

[11] 3,931,336

[45] Jan. 6, 1976

[54] PRODUCTION OF OXYALKYLATED α-HYDROXY ACETYLENIC COMPOUNDS

[75] Inventor: Kurt Schneider, Bad Durkheim, Germany

[73] Assignee: Badische Anilin- & Soda-Fabrik Aktiengesellschaft, Ludwigshafen (Rhine), Germany

[22] Filed: Aug. 20, 1973

[21] Appl. No.: 389,479

[30] Foreign Application Priority Data

Aug. 22, 1972 Germany ..... 2241156
Aug. 22, 1972 Germany ..... 2241157
Aug. 22, 1972 Germany ..... 2241155

[52] U.S. Cl. ..... 260/615 R; 260/615 B; 204/49
[51] Int. Cl.[2] ..... C07C 41/02; C07C 41/10
[58] Field of Search ..... 260/615 B, 615 R

[56] References Cited

UNITED STATES PATENTS

| | | | |
|---|---|---|---|
| 2,674,619 | 4/1954 | Lundsted | 260/613 B |
| 3,293,191 | 12/1966 | Carpenter et al. | 260/615 B |
| 3,341,599 | 9/1967 | Bormann et al. | 260/613 B X |
| 3,366,557 | 1/1968 | Foulke et al. | 260/615 B UX |
| 3,547,881 | 12/1970 | Mueller et al. | 260/613 B |

FOREIGN PATENTS OR APPLICATIONS

| | | | |
|---|---|---|---|
| 893,431 | 6/1962 | United Kingdom | 260/615 B |

OTHER PUBLICATIONS

Gaylord, Polyethers Part I (Highpolymers XIII) Interscience John Wiley & Sons, N.Y., 1963, pp. 33, 34, 105.

Kosolapoff, Organophosphorous Compounds, John Wiley & Sons, New York (1950) pp. 24–25.

*Primary Examiner*—Howard T. Mars
*Attorney, Agent, or Firm*—Johnston, Keil, Thompson & Shurtleff

[57] ABSTRACT

Production of oxyalkylated acetylenic alcohols by reaction of acetylenic alcohols with alkylene oxides in the presence of phosphines, polar aprotic solvents or thioethers.

5 Claims, No Drawings

PRODUCTION OF OXYALKYLATED α-HYDROXY ACETYLENIC COMPOUNDS

The present invention relates to a novel process for the production of mono-oxyalkylated α-hydroxy acetylenic compounds by reaction of α-hydroxy acetylenic compounds with alkylene oxide in an acid-free and alkali-free medium.

Monooxyethylated acetylenic alcohols are important industrial chemicals which can be converted by various routes into important auxiliaries which are useful for example in the textile and paper industries. A particularly important use for these compounds is in the electroplating industry where they find use as brightener additives, particularly in nickel-plating.

Oxyalkylated acetylenic alcohols have hitherto been produced in alkaline medium, i.e. the reaction has been base-catalyzed. U.S. Pat. Nos. 3,366,557 and 3,293,191 disclose, for example, the production of monooxyethylated butynediols by reaction of butynediol with ethylene oxide and alkali metal or alkaline earth metal hydroxides or organic amines as catalysts. The compounds required for the purposes mentioned above, particularly for use in the electroplating field, all have to fulfill high requirements on their purity and their chemical uniformity, and these requirements cannot be completely achieved by the known production methods. The basic catalysts according to the literature references mentioned above tended in particular to lead to a higher degree of oxyalkylation and, above all, to catalyze the back-reaction, i.e. substantial quantities of unconverted acetylenic alcohol or higher oxyalkylated material were to be found in the end product. However, unconverted acetylenic alcohol frequently leads to explosions under the reaction conditions, which means that the operation is not without risk. Moreover, the use of the specified amines as basic catalysts, which was hoped to lead to a smoother reaction, does not have the hoped-for result because higher temperatures are required in order that the catalysts can develop their full activity. The raising of the temperature however leads to the formation of by-products and to an increasing likelihood that the triple bond will give rise to explosive decomposition.

It is an object of the present invention to overcome these disadvantages and to achieve a selective reaction. It is a particular object to provide a catalyst which guarantees a maximum yield for a minimum amount charged and which, above all, does not catalyze the back reaction under the reaction conditions.

Finally, it is a further object that the monooxyethylated acetylenic alcohols produced should meet the special requirements of purity laid down in the electroplating industry.

These objects are achieved in a process for the production of α-hydroxy acetylenic compounds oxyalkylated at the alcoholic hydroxy groups by reaction of one mole of acetylenic alcohol with from 1 to 3 moles of alkylene oxide per hydroxy group, wherein the reaction is carried out in the presence of organic derivatives of phosphine, in the presence of thioethers or in the presence of polar aprotic organic solvents.

The starting materials for the compounds produced in accordance with the process of the invention are α-hydroxy acetylenic compounds having the general formula I $$A-C\equiv C-B$$

in which A is hydrogen or B and B is $$-\underset{\underset{R^1}{|}}{CH}OH,$$

in which $R^1$ is hydrogen or lower alkyl generally of 1 to 4 carbon atoms.

Preferred compounds of the formula I for use in the invention are, for example, butyne-2-diol-1,4, propargyl alcohol, butyne-1-ol-3, hexyne-1-ol-3 and hexyne-3-diol-2,5. Butyne-2-diol-1,4 and propargyl alcohol are particularly preferred.

The alkylene oxides required as the other starting material for the process have the general formula II

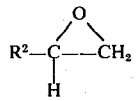

in which $R^2$ is hydrogen or lower alkyl of 1 to 4 carbon atoms, preferably hydrogen or methyl. Ethylene oxide is preferred for industrial purposes.

The acetylenic alcohols are desirably purified before the reaction. This can for example be done in a simple manner by distillation under reduced pressure.

Organic derivatives of phosphine for use in the process of the invention are compounds of the general formula III $$P(R^3)_3$$

in which $R^3$ is alkyl of 1 to 5 carbon atoms, for example methyl, ethyl, n-propyl, iso-propyl, n-butyl, iso-butyl or amyl, or aryl, e.g. unsubstituted or substituted phenyl. Suitable substituents for the phenyl are chlorine, bromine, iodine, amino and nitro and alkyl of 1 to 4 carbon atoms. Tributylphosphine and above all triphenyl phosphine are particularly preferred for use in the invention.

It is admittedly known, for example from German Specification No. 1,543,884, that acidic carbon atoms, for example of carboxylic and phenolic hydroxy groups, can be oxyethylated in the presence of triphenylphosphine, but it has not been previously recognized that the much more inert alcoholic hydroxy groups of α-hydroxy acetylenic compounds can be oxyethylated in the same way.

Thioethers suitable for use in the process of the invention have the general formula IV $$R^4-S-R^5$$

in which $R^4$ and $R^5$ are the same or different and are alkyl of 1 to 4 carbon atoms optionally substituted by hydroxy. Preferably $R^4$ and $R^5$ are the same and are methyl, ethyl, n-propyl, iso-propyl, n-butyl, iso-butyl or amyl, optionally substituted by a single hydroxy. β-bishydroxyethyl sulfide (thiodiglycol) is particularly preferred for use in the invention.

It is admittedly known from German Specification No. 1,248,660 that acidic carbon atoms, for example of carboxylic or phenolic hydroxy groups, can be oxyalkylated in the presence of thioethers, but it has not been previously recognized that the far more inert alcoholic hydroxy groups such as those of acetylenic alcohols, can be oxyethylated in the same way.

Polar aprotic organic solvents suitable for use in the process of the invention are those materials which, like the proton-liberating solvents water and liquid ammonia, have a strong dipole moment. Accordingly, substances such as dimethyl sulfoxide, dimethylformamide, hexamethylphosphoric acid triamide and n-methylpyrrolidone are suitable for use in the invention.

Substances such as hexamethyl phosphoric acid triamide, dimethyl sulfoxide and dimethylformamide are particularly preferred. It is admittedly known from German Specification No. 1,257,776 that strongly acidic hydrogen atoms such as those in carboxylic or phenolic hydroxy groups can be oxyethylated in the presence of aprotic solvents. However, it has not yet been recognized that less reactive acidic hydrogen atoms such as those of acetylenic alochols can be oxyethylated in this way.

The reaction is a simple one and can be carried out by placing the acetylenic alcohol in a pressure vessel, for example an autoclave, and introducing the phosphine or the thioether advantageously in a concentration of from 0.1 to 10%, preferably 0.5 to 3%, based on the weight of the acetylenic alcohol. Thereafter, from 1 to 3,preferably from 1 to 1.1, mole of alkylene oxide per equivalent of hydroxy group is forced into the reaction vessel and allowed to react for about 10 to 16 hours at 50° to 150°C, an internal pressure of from 1 to 20 atmospheres gauge being reached.

When using an aprotic solvent the reaction also is a simple one and can be carried out by placing the acetylenic alcohol and the aprotic organic solvent in a pressure vessel, for example an autoclave, in relative proportions such that the acetylenic alcohol is dissolved in the organic solvent. Desirably, from 10 to 100 parts of the polar solvent are used per 100 parts of acetylenic alcohol. In principle, the solvents can also be used in the same way as described above for the phosphines and thioethers, i.e. the acetylenic alcohol can be introduced without solvent and can be provided with from 0.1 to 10%, preferably from 0.5 to 3%, by weight, with reference to the acetylenic alcohol, of the aprotic solvent. Catalytic quantities are also sufficient in this case.

In principle, the reaction can also be carried out, particularly when phosphines or thioethers are used, in solvents which are inert under the reaction conditions. Suitable solvents are, for example, aromatic hydrocarbons such as benzene, which may optionally be substituted, as well as conventional paraffinic hydrocarbons of the benzine fraction.

The products produced in accordance with the invention are very pure and can be used for all purposes. They are particularly important for use in the electroplating field where they are employed principally as brightener additives in nickel baths.

The following Examples illustrate the invention without limiting it in any way. The parts referred to are parts by weight.

EXAMPLE 1

860 parts of butynediol (10 moles) and 8.6 parts of triphenyl phosphine were introduced into a 3-liter stainless steel autoclave. After the autoclave had been closed it was flushed several times with nitrogen and 902 parts of ehtylene oxide (20.5 moles) were charged over about 12 hours at 55 to 58°C, so that an internal pressure of 3 to 4 atmospheres gauge was reached. The reaction was allowed to continue until the pressure ceased to fall. After pressure had been released 1748 parts of the bis-hydroxyethyl ether of butynediol having a value on the iodine color scale less than 10 and a refractive index $n_D^{20} = 1.4852$ were obtained. The content of free butynediol was less than 0.1%.

EXAMPLE 2

560 parts of propargyl alcohol (10 moles) and 5.6 parts of triphenyl phosphine were reacted in a 2-liter alloy steel autoclave with 451 parts of ethylene oxide (10.25 moles) at 80° to 85°C as described in Example 1. 1002 parts of crude ethylene glycol monopropargyl ether were obtained. 944 parts of pure compound of b.p. 78°C (14 mm) and $n_D^{20} = 1.4502$ were recovered from this material by distillation.

EXAMPLE 3

560 parts of propargyl alcohol (10 moles) and 5.6 parts of triphenyl phosphine were reacted at 95° to 100°C as described in Example 1 with 609 parts of propylene oxide (10.5 moles). 1161 parts of crude propylene glycol monopropargyl ether were obtained, and, after distillation, 1098 parts of pure ether of b.p. 74°C (15 mm) and $n_D^{20} = 1.4449$ were recovered.

EXAMPLE 4

860 parts butynediol (10 moles) and 8.6 parts of thiodiglycol were introduced into a 3-liter stainless steel autoclave. After the autoclave had been closed it was flushed several times with nitrogen and 902 parts of ethylene oxide (20.5 moles) were charged over about 12 hours at 55° to 58°C, so that an internal pressure of 3 to 4 atmospheres gauge was reached. The reaction was allowed to continue until the pressure ceased to fall. After pressure had been released 1745 parts of the bis-hydroxyethyl ether of butynediol having a value on the iodine color scale less than 10 and a refractive index $n_D^{20} = 1.4849$ were obtained. The content of free butynediol was less than 0.1%.

EXAMPLE 5

560 parts of propargyl alcohol (10 moles) and 5.6 parts of ethyl thioethanol were reacted in a 2-liter alloy steel autoclave with 451 parts of ethylene oxide (10.25 moles) at 80° to 85°C as described in Example 1. 998 parts of crude ethylene glycol monopropargyl ether were obtained. 939 parts of pure compound of b.p. 78°C (14 mm) and $n_D^{20} = 1.4502$ were recovered from this material by distillation.

EXAMPLE 6

560 parts of propargyl alcohol (10 moles) and 5.6 parts of thiodiglycol were reacted at 95° to 100°C as described in Example 1 with 609 parts of propylene oxide (10.5 moles). 1155 parts of crude propylene glycol monopropargyl ether were obtained and, after distillation, 1094 parts of pure ether of b.p. 74°C (15 mm) and $n_D^{20} = 1.4449$ were recovered.

EXAMPLE 7

860 parts butynediol (10 moles) and 8.6 parts of hexamethyl phosphoric acid triamide were introduced into a 3-liter stainless steel autoclave. After the autoclave had been closed it was flushed several times with nitrogen and 902 parts of ethylene oxide (20.5 moles) were charged over about 12 hours at 55° to 58°C, so that an internal pressure of 3 to 4 atmospheres gauge was reached. The reaction was allowed to continue until the pressure ceased to fall. After pressure had been released 1744 parts of the bis-hydroxyethyl ether of butynediol having a value on the iodine color scale less than 10 and a refractive index $n_D^{20} = 1.4850$ were obtained. The content of free butynediol was less than 0.1%.

EXAMPLE 8

560 parts of propargyl alcohol (10 moles) and 5.6 parts of dimethyl sulfoxide were reacted in a 2-liter alloy steel autoclave with 451 parts of ethylene oxide (10.25 moles) at 80° to 85°C as described in Example 1. 995 parts of crude ethylene glycol monopropargyl ether were obtained. 932 parts of pure compound of b.p. 78°C (14 mm) and $n_D^{20} = 1.4502$ were recovered from this material by distillation.

EXAMPLE 9

560 parts of propargyl alcohol (10 moles) and 5.6 parts of dimethyl formamide were reacted at 95° to 100°C as described in Example 1 with 609 parts of propylene oxide (10.5 moles). 1150 parts of crude propylene glycol monopropargyl ether were obtained and, after distillation, 1088 parts of pure ether of b.p. 74°C (15 mm) and $n_D^{20} = 1.4449$ were recovered.

I claim:

1. In a process for the production of an α-hydroxy acetylenic compound of the formula $$A\text{-}C \equiv C\text{-}B \qquad \text{I}$$

in which A is hydrogen or B, and B is

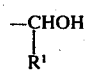

$R^1$ being hydrogen or alkyl of 1 to 4 carbon atoms, oxyalkylated at the hydroxy groups with 1 to 3 moles per hydroxy group of an alkylene oxide having the formula

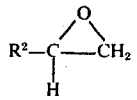

II in which $R^2$ is hydrogen or alkyl of 1 to 4 carbon atoms, the improvement which comprises carrying out the reaction in the presence of 0.1 to 10%, based on the weight of the acetylenic compound, of an organic phosphine derivative of the formula $$P(R^3)_3 \qquad \text{III}$$

in which $R^3$ is alkyl of 1 to 5 carbon atoms, phenyl, chlorophenyl, bromophenyl, iodophenyl, phenylsubstituted by alkyl of 1 to 4 carbon atoms, nitrophenyl or aminophenyl, in a pressure vessel for about 10 to 16 hours at 50° to 150°C. under a pressure of from 1 to 20 atmospheres gauge.

2. A process as claimed in claim 1 wherein the acetylenic compound is selected from the group consisting of butyne-2-diol-1,4 propargyl alcohol, butyne-1-ol-3, hexyne-1-ol-3 and hexyne-3-diol-2,5.

3. A process as claimed in claim 1 wherein the alkylene oxide is ethylene oxide.

4. A process as claimed in claim 1, wherein the organic derivative of phosphine is selected from the group consisting of tributyl phosphine and triphenyl phosphine.

5. A process as claimed in claim 1 wherein the acetylenic hydroxy compound is oxyalkylated with 1 to 1.1 mole of alkylene oxide per hydroxy group.

* * * * *